US009570252B2

(12) United States Patent
Wijekoon et al.

(10) Patent No.: US 9,570,252 B2
(45) Date of Patent: Feb. 14, 2017

(54) SYSTEM AND METHOD FOR OPERATING AN ON-LOAD TAP CHANGER

(71) Applicant: General Electric Company, Schenectady, NY (US)

(72) Inventors: Piniwan Thiwanka Bandara Wijekoon, Munich (DE); Eva-Maria Baerthlein, Hamburg (DE); Simon Herbert Schramm, Munich (DE); Stefan Schroeder, Munich (DE); Ara Panosyan, Munich (DE); Rohit Kumar Gupta, Bangalore (IN)

(73) Assignee: General Electric Company, Niskayuna, NY (US)

( * ) Notice: Subject to any disclaimer, the term of this patent is extended or adjusted under 35 U.S.C. 154(b) by 486 days.

(21) Appl. No.: 14/164,620

(22) Filed: Jan. 27, 2014

(65) Prior Publication Data

US 2015/0213971 A1 Jul. 30, 2015

(51) Int. Cl.
*H01H 9/00* (2006.01)
*H01H 9/54* (2006.01)
*H01F 29/04* (2006.01)

(52) U.S. Cl.
CPC ..... *H01H 9/542* (2013.01); *H01F 29/04* (2013.01); *H01H 9/0005* (2013.01);
(Continued)

(58) Field of Classification Search
CPC ..... G05F 1/10; G05F 1/14; G05F 1/147; G05F 1/16; G05F 1/20; H01F 29/04; H01H 9/0005; H01H 9/0016; H01H 9/0027; H01H 9/54; H01H 9/541; H01H 9/542; H01H 9/548; H01H 2009/544; H01H 2009/546
(Continued)

(56) References Cited

U.S. PATENT DOCUMENTS 3,662,253 A * 5/1972 Yamamoto ..... H01F 29/04 323/343
5,006,784 A 4/1991 Sonntagbauer
(Continued)

FOREIGN PATENT DOCUMENTS

WO 2001022447 A1 3/2001

OTHER PUBLICATIONS

Arrillaga et al., "A Static Alternative to the Transformer On-Load Tap-Changer," IEEE Transactions on Power Apparatus and Systems, Jan./Feb. 1980, vol. PAS-99, No. 1, pp. 86-91.
(Continued)

*Primary Examiner* — Levi Gannon
(74) *Attorney, Agent, or Firm* — Nitin N. Joshi

(57) ABSTRACT

A system for operating an on-load tap changer (OLTC) includes a plurality of legs that include mechanical switches. At least one leg switches from a first to a second tap of the OLTC on receipt of a tap change signal. At least one mechanical switch is activated to establish an electrical connection between one of the first and the second tap and a power terminal of the OLTC. Further, the system includes semiconductor switches that are parallel to the mechanical switches and when activated electrically couple one of the first and the second tap and the power terminal. The system includes a processing unit that selectively activates and deactivates the mechanical and semiconductor switches in such a way that electrical contact is maintained between at least one of the taps and the power terminal during the transition of at least one leg from the first tap to the second tap.

13 Claims, 7 Drawing Sheets

(52) U.S. Cl.
CPC ..... *H01H 9/0016* (2013.01); *H01H 9/0027* (2013.01); *H01H 2009/546* (2013.01)

(58) Field of Classification Search
USPC ..... 323/255, 256, 258, 340, 355; 361/13
See application file for complete search history.

(56) References Cited

U.S. PATENT DOCUMENTS

| | | | | |
|---|---|---|---|---|
| 5,408,171 | A | 4/1995 | Eitzmann et al. | |
| 6,472,851 | B2 | 10/2002 | Hammond | |
| 7,355,369 | B2 | 4/2008 | Lavieville et al. | |
| 7,595,614 | B2 | 9/2009 | Stich et al. | |
| 8,289,068 | B2 | 10/2012 | Brueckl et al. | |
| 8,415,987 | B2 | 4/2013 | Brueckl et al. | |
| 9,087,635 | B2 * | 7/2015 | Rosado | H01F 29/04 |
| 2009/0230933 | A1 | 9/2009 | Oates et al. | |
| 2012/0032654 | A1 | 2/2012 | Brueckl et al. | |
| 2012/0306471 | A1 | 12/2012 | Green et al. | |
| 2012/0313594 | A1 | 12/2012 | Brueckl et al. | |

OTHER PUBLICATIONS

Cooke et al., "New thyristor assisted diverter switch for on load transformer tap changers", Electric Power Applications, IEE Proceedings B, Nov. 1992, vol. 139, No. 6, pp. 507-511.

Gao et al., "A new scheme for on-load tap-changer of transformers", Power System Technology, 2002. Proceedings, 2002, vol. 2, pp. 1016-1020.

D. Dohnal, "On-Load Tap-Changers for Power Transformers a Technical Digest, MR Publication," Jun. 26, 2006, pp. 1-28.

Rogers et al., "A hybrid diverter design for distribution level on-load tap changers", Energy Conversion Congress and Exposition (ECCE), 2010 IEEE, Sep. 12-16, 2010, pp. 1493-1500.

* cited by examiner

SYSTEM AND METHOD FOR OPERATING AN ON-LOAD TAP CHANGER

BACKGROUND

The present invention relates generally to the field of voltage regulation, and more particularly, to on-load tap changers operating as voltage regulation devices.

Conventionally, electricity is generated in large-scale power plants that are connected to a transmission grid. Electrical power is transmitted over a transmission system over long distances at very high voltages. At distribution substations the voltage is stepped down and power is supplied to different loads within a distribution grid. Voltage regulation in the distribution grid is typically achieved through voltage regulation devices such as on-load tap changing transformers or voltage regulators. Capacitor banks are also widely used in many utilities to support the voltage regulation in distribution grids, where voltage variations are mainly caused by slow variation of loads connected to the distribution system. With the growing penetration of intermittent renewable energy resources connected at distribution level, voltage variations in distribution grids are aggravated and becoming more frequent. This development requires more flexibility in network voltage regulation leading to an increased and more extensive utilization of voltage regulation devices in distribution grids.

Voltage regulation devices, such as on-load tap changing transformers, are used to provide regulated voltage to the output terminals. On-load tap changing transformers typically include at least one primary winding and at least one secondary winding. The primary and secondary windings include a plurality of turns. Input voltage is provided to the primary winding and the electric load is coupled to the secondary windings. Magnetic interaction between primary and secondary windings causes energy to be transferred from the primary winding to the secondary winding. Transformers convert the input voltage ($V_{in}$) at the primary windings to an output voltage ($V_{out}$) at the secondary windings based on a turns ratio (T2/T1) of the secondary winding turns ($T_2$) versus primary winding turns ($T_1$). The output voltage is computed based on equation 1:

$$V_{out}=V_{in}\times T_2/T_1 \quad (1)$$

An on-load tap changing transformer has several connection points, so called "taps", along at least one of its windings. With each of these tap positions a certain number of turns is selected. Since the output voltage of the on-load tap changing transformer is determined by the turns ratio of the primary windings versus the secondary windings, the output voltage can be varied by selecting different taps. On-load tap changers (OLTCs) are used to change the tap position of an on-load tap changing transformer while energized, i.e., under load.

Different mechanisms have been developed for OLTCs to change the turns ratio of the primary windings versus the secondary windings of on-load tap changing transformers. Several types of OLTCs, both mechanical and electronic, are available in the market. Mechanical OLTCs allow for in-service operation, but have demanding mechanical requirements. Each tap changing operation of mechanical tap changers leads to a certain amount of arcing between tap contacts and moving finger contacts. Arcing leads to slow deterioration of the transformer oil and accelerated wear-and-tear of mechanical contacts. The lifetime of a mechanical tap changer is hence limited by the number of tap changing operations. Conventional OLTCs have nevertheless a relatively long lifetime of 15-20 years. This is mainly due to the comparably low number of tap changing operations required to regulate the slow voltage variations due to loads. However, more frequent voltage fluctuations in distribution networks can be seen nowadays which are caused by the increasing share of distributed generation by means of renewable energy sources. Therefore, OLTCs are required to operate more frequently than before. This leads to much higher maintenance requirements and limited lifetime. Furthermore, mechanical OLTCs require current limiting inductors or resistors to limit the short-circuit current, which is present during a tap changing operation. Consequently, a need for cooling these current limiting devices may arise due to frequent tap changing occurrences.

The main drawback of mechanical on-load tap changers is unavoidable arcing between the tap contacts and the moving finger contacts when a tap is changed. Purely electronic on-load tap changers on the other hand do not have any moving mechanical contacts. Each tap contact is connected to the load through a solid-state electronic switch. The tap position is selected by switching on the corresponding electronic switch (i.e. conducting), while all other switches are switched off (i.e. not conducting). Changing from one tap position to the other is carried out by commutating the current from one electronic switch to the next. The current commutation is therefore achieved without arcing due to the typically very fast switching capabilities of solid-state switches. Although electronic OLTCs are highly flexible and can operate arc-free and would therefore substantially reduce maintenance requirements as compared to mechanical OLTCs, they also have certain disadvantages. The main drawback is the high cost of electronic switches. Since an electronic switch is required for each tap position, costs are further increased, in particular when the number of taps is higher. The second disadvantage is the higher conduction losses of electronic switches compared to mechanical contacts.

Hence, there is a need for OLTC devices that are economically more viable, require lower maintenance, cause lower conduction losses, and provide for flexibility to meet changing regulation requirements due to the increasing share of intermittent renewable energy resources in the distribution grid.

BRIEF DESCRIPTION

According to one embodiment, a system for operating an on-load tap changer is provided. The system includes a plurality of legs. At least one of the plurality of legs is triggered to switch from a first tap to a second tap of the on-load tap changer on receipt of a tap change signal. Each leg includes a mechanical switch. When at least one mechanical switch of at least one of the plurality of legs is switched on an electrical connection is established between one of the first and the second tap and a power terminal of the on-load tap changer. Further, the system includes a plurality of semiconductor switches. Each semiconductor switch is placed parallel to the mechanical switches and when activated they provide electrical connection between one of the first and the second tap and a power terminal of the on-load tap changer. Furthermore, the system includes a processing unit configured to selectively activate and deactivate the mechanical switches and the semiconductor switches in such a way that electrical contact is maintained between at least one of the taps and the power terminal during the transition of at least one leg from the first tap to the second tap without causing short circuit between two taps.

According to another embodiment, a method for operating an on-load tap changer is provided. The method includes deactivating one or more mechanical switches coupled to at least one of a plurality of legs on one end and a power terminal on the other end when a condition for tap changing is met. The at least one leg is electrically coupled to a first tap of a plurality of taps of the on-load tap changer. Further, the method includes activating a plurality of semiconductor switches that are placed in parallel to the mechanical switches and are coupled to the at least one of the plurality of legs and the power terminal when the condition for tap changing is met. Furthermore, the method includes moving the at least one of the plurality of legs from the first tap towards a second tap. The method also includes selectively activating and deactivating the plurality of semiconductor switches such that the semiconductor switches that are coupled to a moving leg that is in electrical contact with at least one tap are in an active state and the semiconductor switches that are coupled to a moving leg that is not in electrical contact with any tap are in a deactivated state. Furthermore, the method also includes activating the one or more mechanical switches which are coupled to the at least one of the plurality of legs that is in electrical contact with the second tap.

DRAWINGS

Other features and advantages of the present disclosure will be apparent from the following more detailed description of the preferred embodiment, taken in conjunction with the accompanying drawings which illustrate, by way of example, the principles of certain aspects of the disclosure.

Figure 5A:
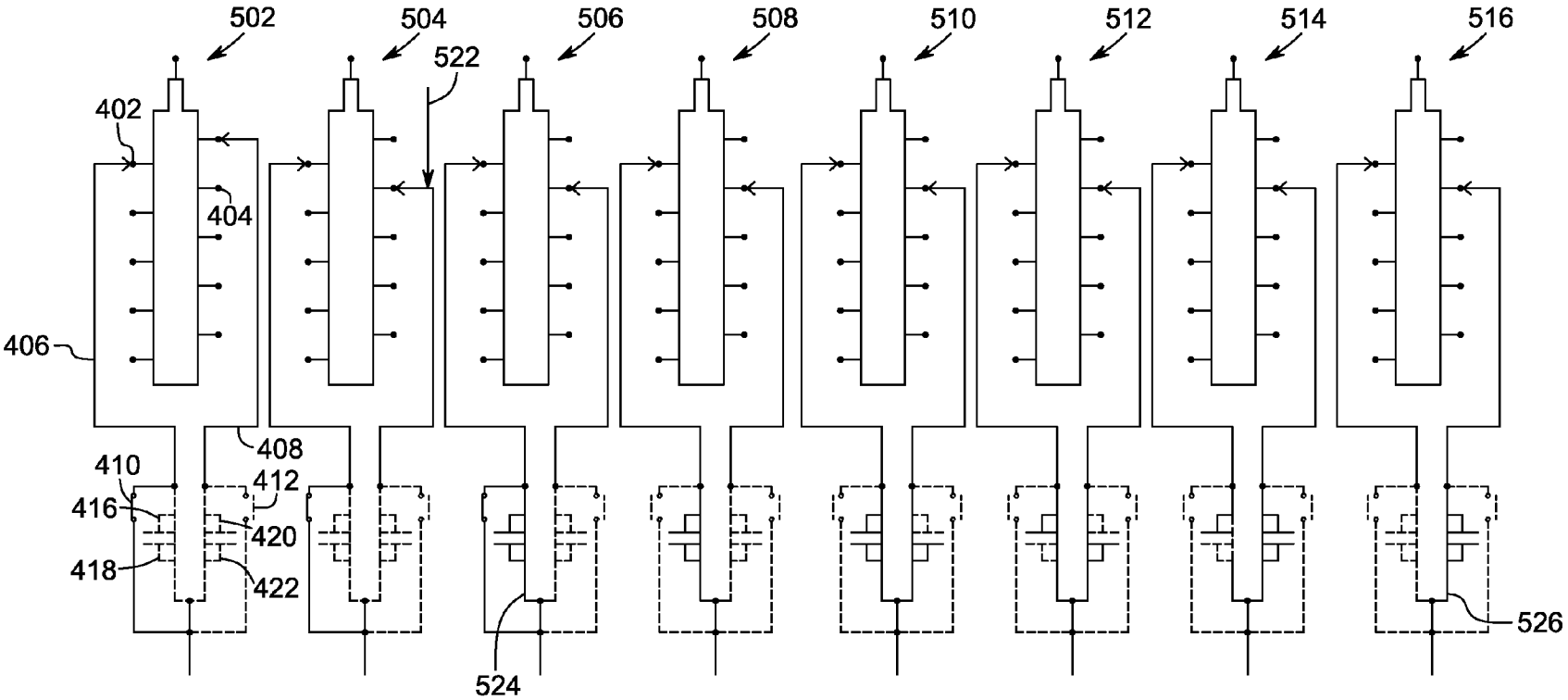
Figure 5B:
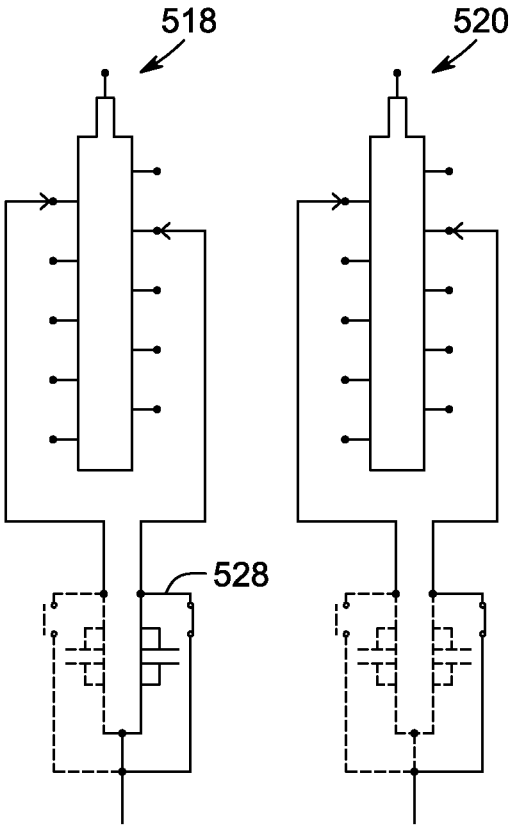
Figure 6:
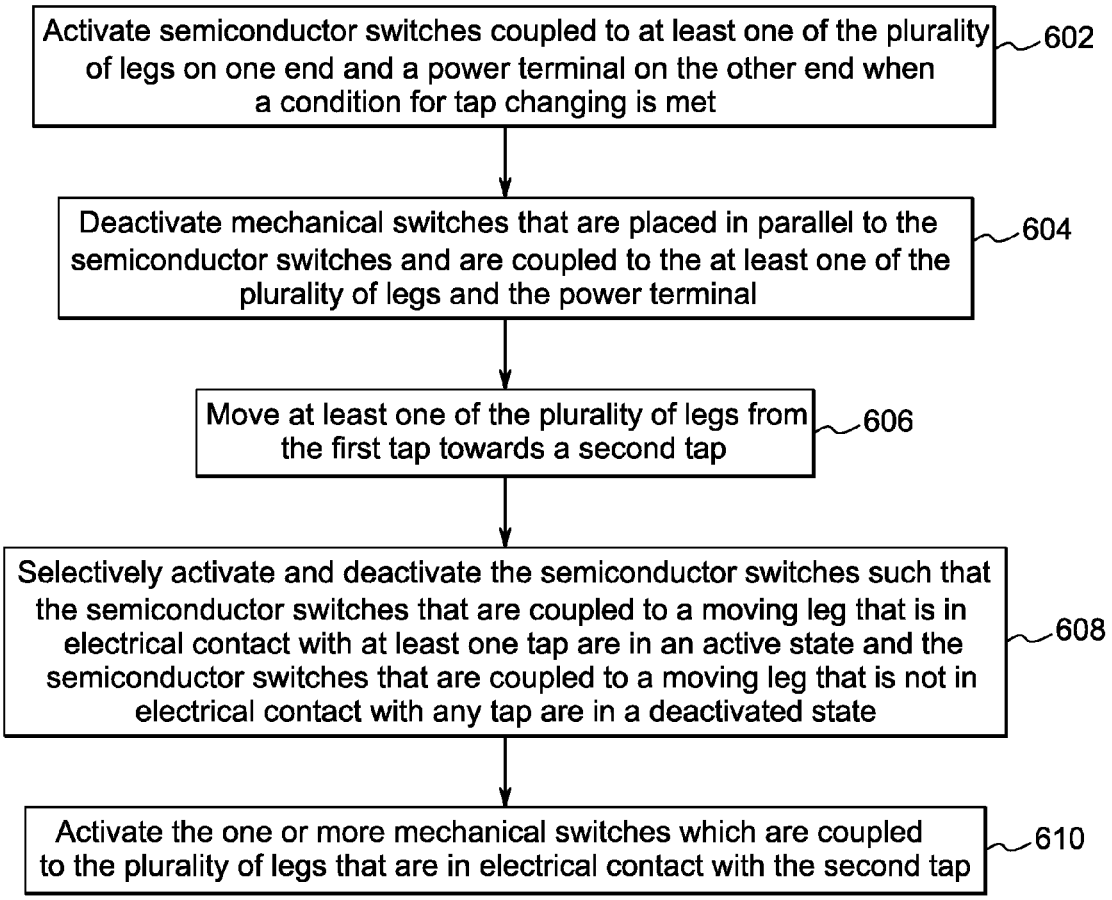

FIGS. 5*a* and 5*b* illustrate a switching sequence of mechanical and semiconductor switches in a linear OLTC, according to one embodiment of the present invention; and FIG. 6 illustrates a method for operating an OLTC, according to embodiments of the present invention.

DETAILED DESCRIPTION

Reference will be made below in detail to exemplary embodiments of the invention, examples of which are illustrated in the accompanying drawings. Wherever possible, the same reference numerals used throughout the drawings refer to the same or like parts.

Embodiments of the present invention provide for a system and method for operating on-load tap changers, as used for voltage regulation by changing connections from one tap to another in voltage regulation devices such as on-load tap changing transformers or voltage regulators. The following description focuses on the use of on-load tap changers in transformers. However, these on-load tap changers can be utilized in any other voltage regulation device with taps. Generally, tap changing transformers are used in transmission and distribution systems to connect networks with different voltage levels. They include a plurality of primary windings and a plurality of secondary windings and a tap changing mechanism. The tap changing mechanism allows selective connection to different transformer taps and thus allows varying the turns ratio ($T_2/T_1$) and thereby regulation of output voltage ($V_{out}$). The tap changing mechanism includes a plurality of electrically conducting legs, which establish electrical connection between a selected tap and the load terminal of the on-load tap changing transformer. When there is a change in system load and the system voltage is outside a permissible voltage band, a controller triggers a tap change operation and the electrically conducting legs are moved from one tap to another. The system and method of operating on-load tap changers (OLTCs), according to embodiments of the invention, aids in eliminating arcing during transition of the legs from one tap to another. The present invention provides a system that includes a plurality of mechanical switches and a plurality of semiconductor switches. When the legs are coupled to one tap, the mechanical switches coupled with the legs are activated to establish a current path from the tap to the power terminal. Upon receiving a tap change signal the semiconductor switches are activated. In an activated state, the semiconductor switches establish a current path between the taps and the power terminal of the voltage regulation device. Before the legs begin to move from a first tap to a second tap, the mechanical switches, as well as the semiconductor switches on the branch first breaking connection with the present tap, are deactivated. The semiconductor switches are configured to commutate the current from the first tap to the second tap without arcing. Further, when the legs are coupled to the second tap, the mechanical switches are activated and the semiconductor switches are deactivated. The system and method can be practiced on voltage regulation devices that include taps and legs for transition between taps. Mechanisms for tap transitions may include rotary mechanisms, as well as linear mechanisms. The system for operation of OLTCs, according to embodiments of the present invention, has been described with respect to linear switching mechanism, as well as rotary switching mechanism. However, the system of operation can also be coupled with other known tap switching mechanisms.

Figure 1:
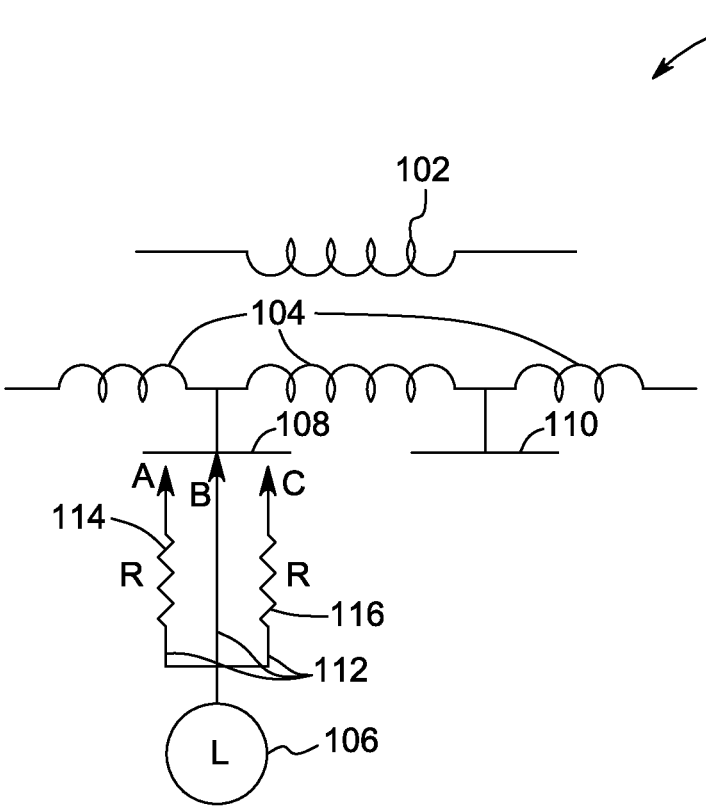
FIG. 1 (Prior Art)
FIG. 1 illustrates a typical voltage regulation device with a selector switch type mechanical on-load tap changer (OLTC)

FIG. 1 illustrates a prior-art voltage regulation device with OLTC 100. The device 100 includes at least one primary winding 102, and at least one secondary winding 104. An input source, such as an electric grid or a battery, may be coupled to at least one of the primary winding 102 or the secondary winding 104. Electric load 106 is coupled to the secondary winding 104 when the input source is coupled to the primary winding 102. The device 100 also includes a plurality of taps 108 and 110. The taps 108 and 110 are configured to establish electrical connection between one of the secondary windings 104 and the electric load 106. The taps 108 and 110 are coupled to the electric load through a plurality of electrically conducting legs (A, B, and C) 112. According to one embodiment, the legs A and C may act as bridging legs and the leg B may act as a steady-state continuously conducting leg. Further, the device 100 also includes a plurality of bridging elements 114 and 116. The bridging elements 114 and 116 are coupled to the legs 112, for example legs A and C, and are disposed in parallel to the steady-state continuously conducting leg B and are placed in series between the taps 108 and 110 and the electric load 106. The bridging elements 114 and 116 may include resistive elements, or reactive elements, or a combination of both. In the illustrated embodiment, resistive elements are placed as the bridging elements 114 and 116.

The legs 112 may transition from one tap 108 to another tap 110 with the help of manual as well as automatic transition mechanisms. Automatic transition mechanisms may include rotary as well as linear transitioning mechanisms. Rotary transitioning mechanisms involve selecting taps, which are placed in a circular fashion, by moving legs 112 with the help of electric motors and driving gear assembly. Linear transitioning mechanisms include legs 112 that are coupled with sliding contacts that are coupled with the taps 108 and 110. The sliding contacts are moved with the help of electric motors and drive gears to couple the legs with different taps 108 and 110.

Bridging legs A and C contains the current limiting elements and in the steady state negligible or no currents are conducted through them while leg B conducts the main steady state current. During operation, when a tap change signal is received, leg B and the bridging legs A and C are moved in the direction of the next selected tap 110. Before the conducting leg B gets decoupled from the first tap 108, leg A connects to the first tap 108. Then conducting leg B breaks contact with the first tap, which leads to arcing. While leg A is still in contact with tap 108, leg C establishes connection to tap 110. In this instance electrical connection between the two taps 108 and 110 is made. However, the short-circuit current is limited by the bridging elements 114 and 116 coupled with the legs A and C. Eventually, the conducting leg B establishes connection with tap 110 and the legs with the two bridging elements 114 and 116 are open circuited completing the tap change operation. The tap change operation leads to significant energy losses in bridging elements 114 and 116 and heat generation. Arcing leads to deterioration of the electrical contacts and maintenance issues.

Figure 2:
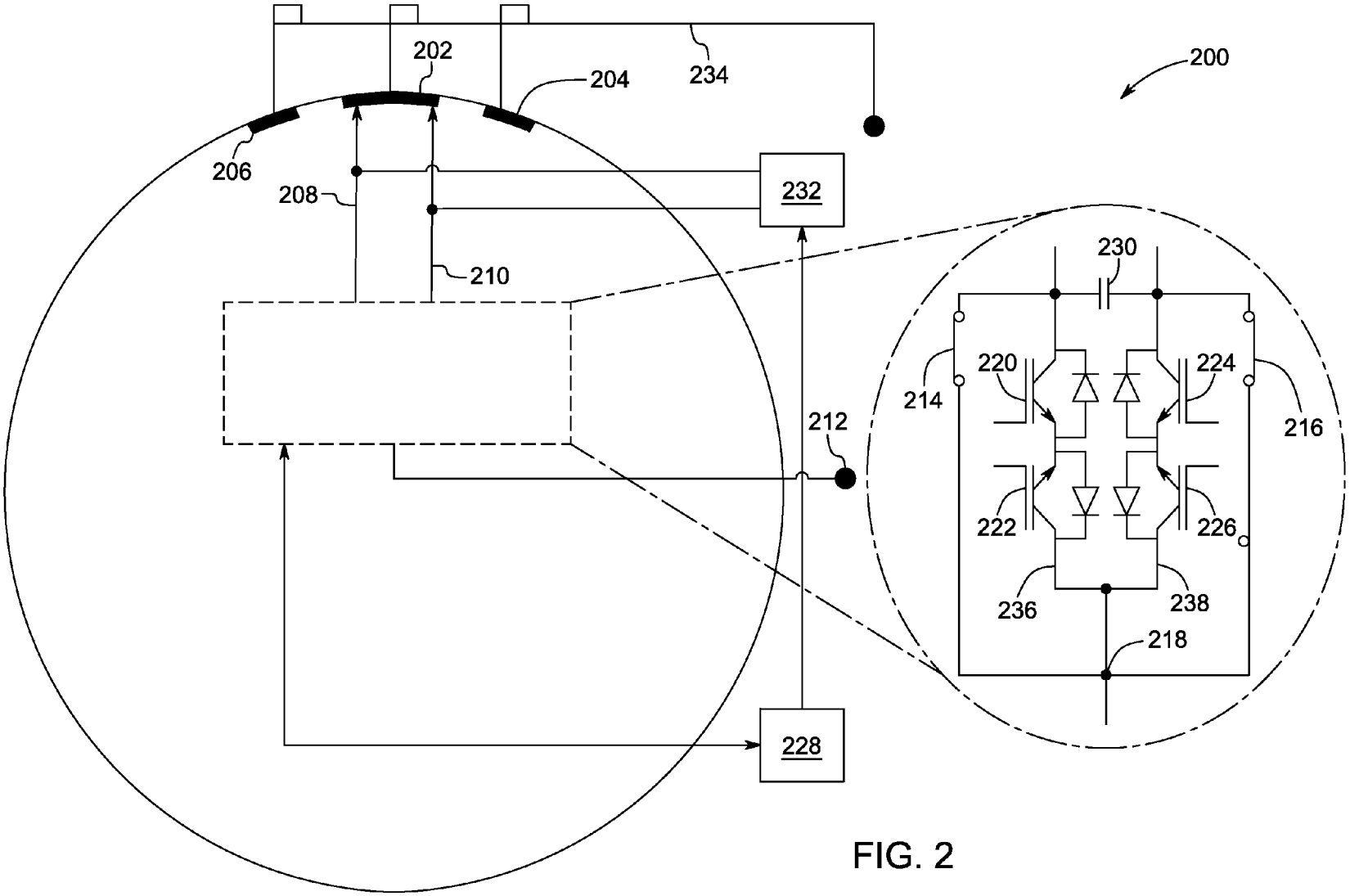
FIG. 2 illustrates a rotary OLTC, according to one embodiment of the present invention.

FIG. 2 illustrates a rotary type OLTC 200 according to one embodiment of the present invention. The rotary type OLTC of FIG. 2 is coupled to a transformer. The transformer, as illustrated in FIG. 1, also includes at least one primary winding (not shown), at least one secondary winding 234, and a plurality of taps 202, 204, and 206. The taps 202, 204, and 206 are coupled to a winding of the transformer. The system 200 further includes a plurality of conducting legs 208 and 210. The legs 208 and 210 are placed parallel to each other and are coupled to a power terminal 212 on one end and are configured to be coupled to one of the taps 202, 204, and 206 on another end. The legs 208 and 210 may be made from electrically conducting materials such as metals.

The system 200 further includes a plurality of no-load mechanical switches 214 and 216. The no-load mechanical switches 214 and 216 are coupled to legs 208 and 210, respectively. Further, the mechanical switches 214 and 216 also couple the legs 208 and 210 to the power terminal 212. The mechanical switches 214 and 216 are placed such that they are parallel to each other and have a common connection point 218 that is coupled to the power terminal 212. The mechanical switches 214 and 216, in a conducting/activated state, establish a current path between the taps 202, or 204, or 206 and the power terminal 212. When the legs 208 and 210 are coupled with one of the taps 202, or 204, or 206 and the switches 214 and 216 are activated, the current flowing from the connected tap is carried from the legs 208 and 210 through two parallel current paths defined by the switches 214 and 216 and is supplied to the power terminal through the common connection point 218.

The system also includes a plurality of semiconductor switches 220, 222, 224, and 226. According to embodiments of the present invention, the semiconductor switch pairs 220, 222 and 224, 226 form bi-directional controllable semiconductor switches. Examples of fully controllable semiconductor switches 220, 222, 224, and 226 may include, but are not limited to, insulated gate bipolar transistors (IGBTs), metal oxide semiconductor field effect transistors (MOSFETs), other types of field effect transistors (FETs), gate turn-off thyristors, insulated gate commutated thyristors (IGCTs), or injection enhanced gate transistors (IEGTs), for example, or combinations thereof. The materials of such switches may comprise silicon, silicon carbide, gallium nitride, gallium arsenide or combinations thereof, for example. The semiconductor switches 220, 222, 224, and 226 are placed to define a plurality of branches 236 and 238. Each branch 236 and 238 of semiconductor switches may include an equal number of semiconductor switches and is placed parallel to the remaining branches of semiconductor switches and mechanical switches 214 and 216. When activated with gating signals of appropriate magnitude, the semiconductor switches 220, 222, 224, and 226 are configured to be in a conducting state. In the illustrated embodiment, semiconductor switches 220, 222, 224, and 226 are divided in two branches that are placed parallel to each other. Each branch is coupled to one of the legs 208 and 210 on one end and is coupled to the common connection point 218 on another end. The semiconductor switches 220, 222, 224, and 226 are thus placed in parallel to the mechanical switches 214 and 216.

The system also includes a processing unit 228. The processing unit 228 is coupled with the mechanical switches 214 and 216, as well as semiconductor switches 220, 222, 224, and 226 and is configured to provide activation and deactivation signals to the switches 214, 216, 220, 222, 224, and 226. The processing unit 228 may also be configured to generate a tap change signal when the regulated voltage at 212 is outside a permissible bandwidth. The processing unit 228 is configured to communicate the tap change signal to a leg driving system 232 coupled with the plurality of legs 208 and 210. The leg driving system 232, according to other embodiments, may include switches that are coupled to electric motors and gear assemblies. The tap change signal generated by the processing unit 228 is provided to the leg driving system 232. Then electric energy is provided to the electric motors that begin operating the gear assembly. The gear assembly may be coupled with the plurality of legs 208 and 210. Due to the movement of the gear assembly, the plurality of legs 208 and 210 begin moving in a predefined direction to couple with another tap of the voltage regulation device.

During transition of the legs 208 and 210 from one tap to another, for example, the first tap 202 to the second tap 204, the processing unit 228 is configured to selectively activate and deactivate the semiconductor switches 220, 222, 224, and 226. The processing unit 228 activates at least one semiconductor switch 220, 222, 224, and 226 from the branch 236 or branch 238 that is coupled with any of the taps 202, or 204. The processing unit 228 is further configured to keep the remaining semiconductor switches deactivated. The switching pattern of the semiconductor switches 220, 222, 224, and 226 is decided by the processing unit 228 to avoid arc formation during transition of the legs 208 and 210. When the transition of the legs 208 and 210 from one tap to another is completed and the plurality of legs 208 and 210 are coupled with only one of the taps 202, or 204, or 206 the processing unit 228 is configured to discontinue the tap change signal and the mechanical switches 214 and 216 are activated to establish the defined current paths.

In the illustrated embodiment, the legs 208 and 210 are coupled to the first tap 202. In steady-state operations of the OLTC, according to an embodiment, the mechanical switches 214 and 216 are in an activated state and the semiconductor switches 220, 222, 224, and 226 are in a deactivated state. In another embodiment of steady-state operations, the switches 214, and 216 and the semiconductor switches 220, 222, 224, and 226 may be in an active state. The mechanical switches provide a current path from the first tap 202 to the power terminal 212. The voltage on power terminal 212 is proportional to the ratio of primary winding turns and the number of secondary winding turns selected by the first tap 202. According to certain embodiments, the power delivered by the voltage regulation device may be used to energize an electric load which is coupled to the power terminal 212. When voltage requirement of the electric load changes or the required voltage is outside a permissible bandwidth, the processing unit 228 is configured to generate a tap change signal. On receipt of the tap change signal, the mechanical switches 214 and 216 are deactivated and the semiconductor switches 220, 222, 224, and 226 are activated. After the branch 238 with semiconductor switches 224 and 226 is deactivated, the legs 208 and 210 begin moving towards the second tap, for example the tap 204. During transition of legs 208 and 210 from the first tap 202 to the second tap 204, the semiconductor switches 220, 222, 224, and 226 are selectively activated and deactivated such that at least one of the first tap 202 and the second tap 204 is electrically coupled to the power terminal 212 and arcing is avoided. The selective activation and deactivation of semiconductor switches 220, 222, 224, and 226 will be explained in greater detail in conjunction with FIG. 3.

The processing unit 228 may further be configured to detect when both legs 208 and 210 have reached the second tap 204. Further, when legs 208 and 210 get coupled to the second tap 204, the processing unit 228 may also be configured to activate mechanical switches 214 and 216 and deactivate semiconductor switches 220, 222, 224, and 226. Thus, mechanical switches 214 and 216 provide the current path from the tap 204 to the power terminal 212.

In the illustrated embodiment, the system for operation also includes a snubbing device 230. The snubbing device 230 is configured to protect the semiconductor switches 220, 222, 224, and 226 and the mechanical switches 214 and 216 from overvoltage due to interruption of current through the tap leakage inductance during a tap change. In the illustrated embodiment, the snubbing device 230 is a capacitive element. Other examples of the snubbing device 230 include, but are not limited to, RC snubbers and metal oxide varistors. The capacitive element is configured to store surges of energy flowing from the tap to the power terminal 212 during transition of the legs and release the stored energy when the legs 208 and 210 have transitioned from the first tap 202 to the second tap 204. In the illustrated embodiment, the snubbing device 230 is coupled in parallel with the branches 236 and 238. In other embodiments, a plurality of snubbing devices may be utilized for protection of the semiconductor switches 220, 222, 224, and 226. For example, one snubbing device may be coupled in parallel with each of the branches 236 and 238. Further, in other embodiments, one or more snubbing devices may be coupled in parallel with each semiconductor switches 220, 222, 224, and 226.

Figure 3:
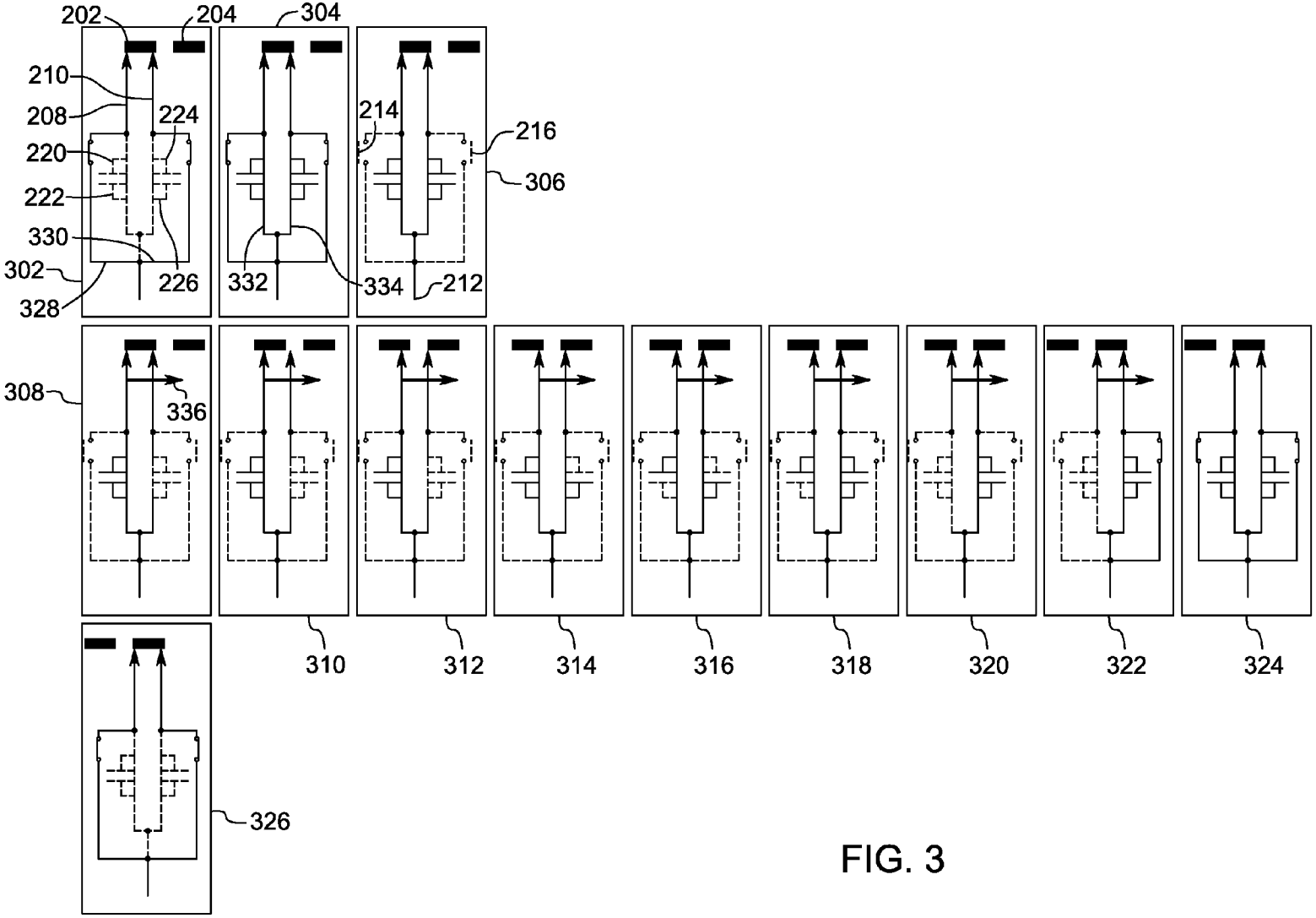
FIG. 3 illustrates a switching sequence of mechanical and semiconductor switches in a OLTC, according to one embodiment of the present invention.

FIG. 3 illustrates a switching sequence of the mechanical switches 214 and 216 and semiconductor switches 220, 222, 224, and 226 in the system of FIG. 2, according to one embodiment of the present invention. The processing unit, such as the processing unit 228, is configured to selectively activate and deactivate the semiconductor switches 220, 222, 224, and 226 when the legs 208 and 210 move from one tap to another. At 302, when the legs 208 and 210 are coupled to the first tap 202 the mechanical switches 214 and 216 are in an active state and the semiconductor switches 220, 222, 224, and 226 are deactivated. Current paths 328 and 330 that are defined by the mechanical switches 214 and 216 couple the tap 202 and the power terminal 212. When a condition for tap changing is detected by the processing unit, at 304, the semiconductor switches 220, 222, 224, and 226 are activated. The semiconductor switches 220, 222, 224, and 226 are activated by providing each semiconductor switch 220, 222, 224, and 226 with gating signals. The activation of semiconductor switches 220, 222, 224, and 226 leads to creation of two additional current paths 332 and 334. At 306, mechanical switches 214 and 216 are deactivated and current paths 332 and 334 are utilized to couple tap 202 with the power terminal 212. At 308, one branch of semiconductor switches 224 and 226 coupled to the leg in the direction of movement, i.e., the leg that is to first disconnect from the present tap 202, is deactivated.

Further, in response to the condition for tap changing, the processing unit is configured to generate a tap changing signal. The tap changing signal is provided to the leg driving system of the legs 208 and 210. The tap changing signal causes the legs 208 and 210 to start transitioning from the first tap 202 to the second tap as shown at 308 where the legs 208 and 210 begin their transition in the direction represented by arrow 336. In the illustrated embodiment, legs 208 and 210 begin moving from the first tap 202 to the second tap 204. In the embodiment, the resulting voltage at power terminal 212 is higher when the legs are coupled to the second tap 204 than when the legs are connected to the first tap 202. At 310, leg 210 gets decoupled from the first tap 202. The current flowing from the first tap 202 is provided to the power terminal through the current path 332 defined by leg 208 and activated semiconductor switches 220 and 222. At 312, leg 210 makes contact with the second tap 204. At 314, after leg 210 is coupled with the second tap 204, the processing unit activates at least one semiconductor switch that is coupled with leg 210. In one embodiment, the processing unit activates at least one of the semiconductor switches 224 or 226 immediately after leg 210 makes contact with tap 204. In other embodiments, the processing unit activates one of the semiconductor switches 224 and 226 after a time interval after leg 210 and tap 204 make contact. In the illustrated embodiment, the processing unit activates the semiconductor switch 226 that is coupled with the leg 210. At 316, when the leg 208 is still coupled with the first tap 202 at least one semiconductor switch coupled to the leg 208 is deactivated. As shown in FIG. 3, the semiconductor switch 222 is deactivated. At 316, leg 208 is coupled with the first tap 202, leg 210 is coupled with the second tap 204, and the semiconductor switches 220 and 226 are in active state.

At 318, the processing unit activates the second semiconductor switch 224. At 320, the processing unit deactivates the semiconductor switch 220 such that current path through leg 208 is broken. Both the semiconductor switches 220 and 222 coupled to leg 208 are deactivated when leg 208 is decoupled from the first tap 202. At the same time both semiconductor switches 224 and 226 are activated and load current is diverted to flow through current path 334. At 322, leg 208 makes contact with the second tap 204 and mechanical switch 216 is activated. At 324, when both legs 208 and 210 are coupled with the second tap 204, the processing unit stops the tap change signal. The discontinuation of the tap change signal deactivates the leg driving system, which in turn stops the legs 208 and 210 from moving. At this instant, the semiconductor switches 220 and 222, and the mechanical switch 214 are activated. At this point the semiconductor switches 220, 222, 224, and 226 as well as the mechanical switches 214 and 216 are in an active state and load current is split between current paths 328, 330, 332 and 334. At 326, the semiconductor switches 220, 222, 224, and 226 are deactivated, and the second tap 204 and the power terminal 212 are coupled through the current paths 328 and 330 defined by the mechanical switches 214 and 216.

The illustrated switching sequence to commutate current from current path 332 to 334 is called four-step current commutation. The four-step current commutation process includes sequence steps 312-320 in which the semiconductor switches 220, 222, 224, and 226 are selectively activated and deactivated to change the current path from the first tap 202 to the second tap 204. Four-step current commutation can be sequenced based on comparison of voltage magnitude between voltages at the two taps or based on the direction of the current through power terminal 212. The illustrated sequence is based on a comparison between voltage magnitude at the first tap 202 and voltage magnitude at the second tap 204.

According to other embodiments, the switching sequence for the semiconductor switches 220, 222, 224, and 226 may include a two-step current commutation process to commutate current from the first tap 202 to the second tap 204. The two-step current commutation process is based on the knowledge of both voltage differences between the first tap 202 and the second tap 204 as well as current direction at power terminal 212. As may be obvious to one skilled in the art, that while two methods are described in the foregoing paragraphs other variations of the switching sequence may also be implemented to selectively activate and deactivate the semiconductor switches 220, 222, 224, and 226 to achieve arc-less, short circuit free and uninterrupted current commutation from the leg 208 to the leg 210.

Figure 4:
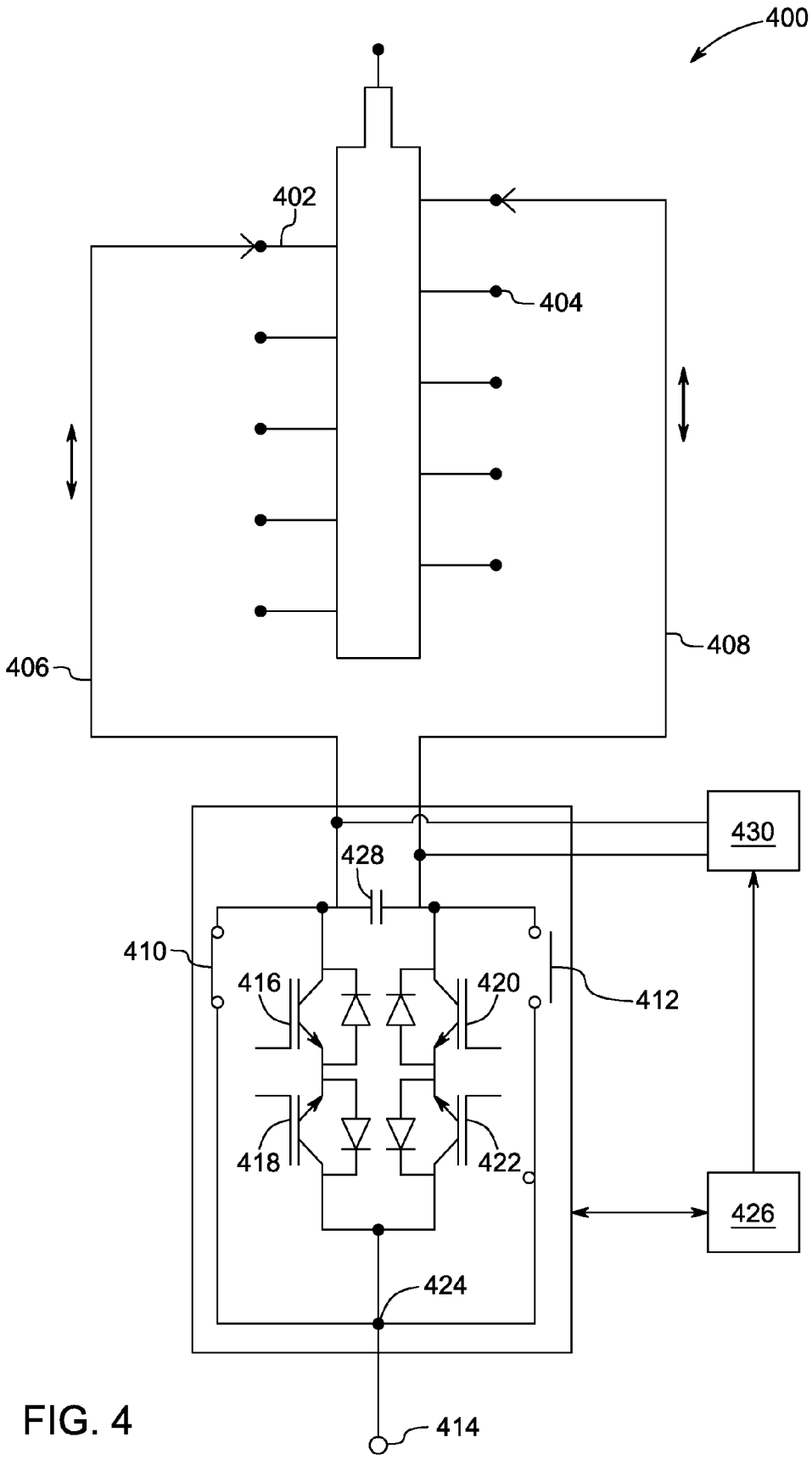
FIG. 4 illustrates a linear OLTC, according to one embodiment of the present invention.

FIG. 4 illustrates a linear OLTC 400 configured to operate a voltage regulation device, according to one embodiment of the present invention. The tap changer 400 includes a plurality of taps such as taps 402 and 404, a plurality of legs 406 and 408, a plurality of mechanical switches 410 and 412, a power terminal 414, a plurality of semiconductor switches 416, 418, 420, and 422, a common connection point 424, a processing unit 426, and a snubbing device 428. The plurality of taps 402 and 404, when coupled to the power terminal 414, provide a desired turns ratio between the primary winding and the secondary winding of the transformer (not shown). The plurality of legs 406 and 408 are configured to couple with one of the plurality of taps 402 and 404. The mechanical switches 410 and 412 are coupled to respective legs 406 and 408. The legs with mechanical switches 410 and 412 are coupled to the common connection point 424, which is further coupled to the power terminal 414. The processing unit 426 is configured to detect the need for a tap change operation if the regulated voltage is outside a permissible voltage band. Based on the actual value of the regulated voltage, the processing unit 426 activates either switch 410 or switch 412 to couple one of the taps 402 or 404 to the power terminal 414. For example, in the illustrated embodiment, the first tap 402 of the device 400 is selected. In such a case, the switch 410 which is coupled to leg 406 that is coupled to tap 402 is activated.

When the regulated voltage is outside a permissible voltage band, a tap change signal is generated by the processing unit 426 that is configured to move the legs 406 and 408 to couple an appropriate tap to the power terminal 414. The processing unit 426 is configured to communicate the tap change signal to a leg driving system 430. The leg driving system 430 is mechanically coupled with the legs 406 and 408. When the leg driving system 430 receives the tap change signal, electric devices cause a gear assembly of the driving system 430 to move. The gear assembly, in turn, causes the legs 406 and 408 to move in a particular direction. For example, the tap change signal may be indicative of coupling the second tap 404 to the power terminal 414. In such an embodiment, leg 408 slides to the second tap 404 while mechanical switch 412 is still deactivated and current is flowing through mechanical switch 410. Upon establishing connection between leg 408 and tap 404 the mechanical switch 412 that is coupled to leg 408 is activated. Further, the switch 410 coupled to leg 406 is deactivated. During the transition of the legs from tap 402 to tap 404, the processing unit 426 is configured to selectively activate and deactivate the semiconductor switches 416, 418, 420, and 422 to commutate the current from one tap to another without arcing and without interruption of load current.

FIGS. 5*a* and 5*b* illustrate a switching sequence of the mechanical switches 410 and 412 and semiconductor switches 416, 418, 420, and 422 in the system of FIG. 4, according to one embodiment of the present invention. The processing unit, such as the processing unit 426, is configured to selectively activate and deactivate the semiconductor switches 416, 418, 420, and 422 during transition of the legs 406 and 408 from one tap to another. In the illustrated embodiment, at 502 the mechanical switch 410 that is coupled with the leg 406 is active. Leg 406 is coupled to the first tap 402 and current path to the power terminal 414 is given through tap 402, leg 406 and mechanical switch 410. When a tap change signal is received, at 504, leg 408 begins moving towards the second tap 404 in the direction as indicated by arrow 522. At 506, the semiconductor switches 416 and 418 that are coupled to leg 406 are activated. An additional current path 524 is established between the first tap 402 and the power terminal 414 through the semiconductor switches 416 and 418. At 508, the processing unit deactivates the mechanical switch 410 that is coupled to leg 406. Further, at 510, the processing unit activates at least one semiconductor switch, such as semiconductor switch 422, which is coupled to leg 408 that is now coupled to the second tap 404. Furthermore, at 512, the processing unit deactivates at least one semiconductor switch coupled to leg 406 (e.g. semiconductor switch 418). At 514, the processing unit activates the second semiconductor switch (e.g. 420) that is coupled to leg 408. At 516, the active semiconductor switch 416 coupled with leg 406 is turned off. At this point, the current flowing from the voltage regulation device has been commutated to tap 404 and is directed through a current path 526 that couples the second tap 404 through the active semiconductor switches 420 and 422 with the power terminal 414. At 518, mechanical switch 412 coupled with leg 408 is activated. The current flowing from the voltage regulation device is delivered to the power terminal 414 through current path 526 and current path 528 defined by the mechanical switch 412. At 520, the semiconductor switches 420 and 422 are deactivated when the tap change signal is discontinued. Load current is now flowing only through current path 528 and the tap change operation is completed.

FIG. 6 illustrates a method for operating voltage regulation devices, according to embodiments of the present invention. The method for operation is utilized to regulate voltage provided to an electric load without causing arcing in the on-load tap changing device. The regulated voltage is measured to be outside a permissible bandwidth and the windings ratio of the voltage regulation device is changed to provide the required voltage to the load. The tap changing device, as illustrated in FIGS. 2 and 4, include a plurality of taps, a plurality of legs, a plurality of mechanical switches, a plurality of semiconductor switches, and a processing unit. The method includes selectively activating and deactivating the mechanical switches and the semiconductor switches during the transition of the plurality of legs from one tap to another such that no arcing occurs and that load current is not interrupted.

At 602, the method includes activating a plurality of semiconductor switches that are that are coupled to at least one of the plurality of legs on one end and the power terminal on the other end when a condition for tap changing is met. At 604, the method includes deactivating one or more mechanical switches that are placed in parallel to the semiconductor switches and are coupled to the at least one of the plurality of legs on one end and the power terminal on the other end when a condition for tap changing is met. Mechanical switches that are coupled to a first leg that is coupled to a first tap of the voltage regulation device are deactivated. At 606, after the current path through the first leg has been broken by deactivating the semiconductor switches coupled to the first leg, at least one of the plurality of legs is moved towards a second tap of the voltage regulation device as a reaction to a tap change signal. The tap change signal is generated in response to a condition for tap changing being met. An exemplary condition for tap changing includes a change in generation or load in the network connected to the power terminal causing the regulated voltage to leave a permissible voltage bandwidth. The tap change signal, according to one embodiment, is generated by a processing unit. The processing unit communicates the tap change signal to a leg driving system that initiates the movement of the legs.

During the movement of the legs from one tap to another, at 608, the method includes selectively activating and deactivating the plurality of semiconductor switches. The semiconductor switches are activated and deactivated such that at least one of the semiconductor switches coupled with any leg that is in electrical contact with any tap of the voltage regulation device are kept active and the semiconductor switches that are coupled with any leg that is not in contact with any tap are deactivated. This activation and deactivation of switches ensures that load current is not interrupted. Further the semiconductor switches are activated and deactivated such that no arcing occurs. At 610, when at least one of the legs is in contact with the second tap the mechanical switches that are coupled to the legs that are in contact with the second tap are activated to create a steady-state current path for the current flowing from the voltage regulation device to the power terminal.

In one embodiment, before the legs begin moving from the first tap to the second tap, the mechanical switch that is coupled to the first leg is deactivated before the leg movement. Further, when the first leg reaches the second tap, semiconductor switches in the second leg are activated. After the activation of semiconductor switches, the mechanical switch connected to the second leg is deactivated. Once the semiconductor switches in the second leg completely take over the load current, the four-step current commutation can be performed between the semiconductor switches in both legs, in order to have a smooth current commutation from the first tap to the second tap. Thereafter, mechanical switch in the first leg can be activated and the parallel semiconductor switches can be deactivated.

In another embodiment, before the legs begin moving from the first tap to the second tap, the semiconductor switches are activated before the mechanical switches that are coupled to each leg are deactivated. Furthermore, the method includes deactivating the semiconductor switches that are coupled to the first leg that is moving away from the first tap towards the second tap. That way, when the first leg is decoupled from the first tap, the semiconductor switches connected to the first leg are turned off and no active current path is interrupted. The method also includes a commutation method, such as four-step commutation as illustrated in FIGS. 3 and 5, which is performed to commutate the current from the first tap to the second tap. After this current commutation current is flowing through the semiconductor switches coupled with the first leg. After both legs have reached the second tap, the mechanical switch coupled with the first leg is activated to create an additional current path for the load current. Further, the semiconductor switches coupled with the rest of the legs are activated, as well as the mechanical switch connected to the second leg. At this instance all mechanical as well as semiconductor switches are activated. To complete the tap changing operation, the semiconductor switches are switched off while leaving the mechanical switches active to provide a current path for the load current in steady-state.

The method and system for operation of OLTCs described in the foregoing paragraphs eliminates arcing between the tap contacts and the legs when a tap is changed. This reduces wear-and-tear of the mechanical contacts and deterioration of regulation device oil. Thus, the cost of maintenance of the system is reduced and the lifetime of the load tap changer device is increased. Further, smaller mechanical switches can be utilized, thereby reducing the size of the system of operation. Moreover, since there is no need for current limiting devices, the need for cooling these elements is avoided.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments of invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

As used herein, the term "processing unit" refers to software, hardware, or firmware, or any combination of these, or any system, process, or functionality that performs or facilitates the processes described herein.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for operation of load tap changers, without departing from the spirit and scope of the invention herein involved, it is intended that all of the subject matter of the above description or shown in the accompanying drawings shall be interpreted merely as examples illustrating the inventive concept herein and shall not be construed as limiting the invention.

The invention claimed is:

1. A system for operating an on-load tap changer, the system comprising:

a plurality of legs, at least one of which is triggered to switch from a first tap to a second tap of the on-load tap changer on receipt of a tap change signal, wherein each leg includes at least one mechanical switch, and wherein when at least one mechanical switch of at least one of the plurality of legs is switched on an electrical connection is established between one of the first and the second tap and a power terminal of the on-load tap changer; and a plurality of semiconductor switches, each semiconductor switch being placed parallel to the mechanical switches and when activated provide electrical connection between one of the first and the second tap and a power terminal of the on-load tap changer;

a processing unit configured to selectively activate and deactivate the mechanical switches and the semiconductor switches in such a way that electrical contact is maintained between at least one of the taps and the power terminal during the transition of at least one leg from the first tap to the second tap without causing short circuit between two taps;

wherein the processing unit is further configured to:

generate the tap change signal to move the at least one leg from the first tap to the second tap when a condition for tap changing is met;

generate activation signals for the semiconductor switches when the tap change signal is generated; and generate a plurality of deactivation signals for the mechanical switches of the at least one leg coupled with the first tap when a condition for tap changing is met.

2. The system of claim 1, further comprising a leg driving system configured to receive the tap change signal from the processing unit and causing the at least one leg to move in the direction of the second tap.

3. The system of claim 1, wherein the processing unit is further configured to:

generate a first deactivation signal for the semiconductor switches that are coupled to a first leg from the plurality of legs that is changing position from the first tap towards the second tap before the first leg is decoupled from the first tap;

generate a second deactivation signal for one or more of the plurality of semiconductor switches coupled to a second leg once the first leg is coupled with the second tap;

generate a first activation signal for the mechanical switch that couples the first leg to the power terminal when the first leg is coupled with the second tap;

generate a second activation signal for the remaining mechanical switches that couple the plurality of legs to the power terminal; and generate a third deactivation signal for the plurality of semiconductor switches.

4. The system of claim 1 further comprising at least one snubbing device that is coupled in parallel to the plurality of semiconductor switches.

5. The system of claim 1, wherein the semiconductor switches comprise a bidirectional switch or a unidirectional switch.

6. The system of claim 1, wherein the semiconductor switches comprise at least one of a MOSFET, IGBT, and IGCT.

7. The system of claim 1, wherein the on-load tap changer comprises a rotary tap selection mechanism.

8. The system of claim 1, wherein the on-load tap changer comprises a linear tap selection mechanism.

9. A method for operating an on-load tap changer, the method comprising:

activating a plurality of semiconductor switches coupled to at least one of a plurality of legs on one end and a power terminal on the other end when a condition for tap changing is met, wherein the at least one leg is electrically coupled to a first tap of a plurality of taps of the on-load tap changer;

deactivating one or more mechanical switches that are placed in parallel to the plurality of semiconductor switches and are coupled to the at least one of the plurality of legs on one end and the power terminal on the other end;

moving the at least one of the plurality of legs from the first tap towards a second tap;

selectively activating and deactivating the plurality of semiconductor switches such that the semiconductor switches that are coupled to a moving leg that is in electrical contact with at least one tap are in an active state and the semiconductor switches that are coupled to a moving leg that is not in electrical contact with any tap are in a deactivated state; and activating the one or more mechanical switches which are coupled to the at least one of the plurality of legs that is in electrical contact with the second tap.

10. The method of claim 9, further comprising:

generating a plurality of activation signals for the plurality of semiconductor switches when the condition for tap changing is met; and generating deactivation signals for the mechanical switches when the condition for tap changing is met.

11. The method of claim 10, wherein selectively activating and deactivating further comprises:

generating a first deactivation signal for the semiconductor switches that are coupled to a first leg from the plurality of legs that is changing position from the first tap towards the second tap before the first leg is decoupled from the first tap;

generating a second deactivation signal for one or more of the plurality of semiconductor switches coupled to a second leg once the first leg is coupled with the second tap;

generating a first activation signal for the mechanical switch that couples the first leg to the power terminal when the first leg is coupled with the second tap;

generating a second activation signal for the remaining mechanical switches that couple the plurality of legs to the power terminal; and generating a third deactivation signal for the plurality of semiconductor switches.

12. The method of claim 10, wherein selectively activating and deactivating further comprises:

generating a first activation signal for one or more of the plurality of semiconductor switches that are coupled to a first leg from the plurality of legs when the first leg is coupled to the second tap;

generating a first deactivation signal for one or more of the plurality of semiconductor switches coupled to a second leg once the first leg is coupled with the second tap, wherein the second leg is coupled to the first tap; and generating a second activation signal for the mechanical switch that couples the first leg to the power terminal.

13. The method of claim 12, further comprising generating a second deactivation signal for the plurality of semiconductor switches.

* * * * *